US009633531B1

(12) United States Patent
Taylor

(10) Patent No.: US 9,633,531 B1
(45) Date of Patent: Apr. 25, 2017

(54) CLAMP AND PIVOTING FLAG FOR TABLES

(71) Applicant: Serverflags, LLC, Melbourne, FL (US)

(72) Inventor: Joshua R. Taylor, Melbourne, FL (US)

(73) Assignee: ServerFlags, LLC, Melbourne, FL (US)

( * ) Notice: Subject to any disclaimer, the term of this patent is extended or adjusted under 35 U.S.C. 154(b) by 183 days.

(21) Appl. No.: 14/610,500

(22) Filed: Jan. 30, 2015

(51) Int. Cl.

| | |
|---|---|
| ***G08B 5/02*** | (2006.01) |
| ***G09F 11/23*** | (2006.01) |
| ***G09F 23/06*** | (2006.01) |
| ***G09F 23/00*** | (2006.01) |

(52) U.S. Cl.
CPC ..... *G08B 5/02* (2013.01); *G09F 23/00* (2013.01); *G09F 23/06* (2013.01)

(58) Field of Classification Search
CPC ..... G09F 11/00; G09F 11/02; G09F 11/04; G09F 11/06; G09F 11/23; G09F 23/06; G09F 23/08; G08B 5/02
USPC ..... 116/307, 308, 309, 310, 311, 312, 313, 116/314, 315, 316, 317, 318, 319, 320; 40/647, 648, 658, 659, 666
See application file for complete search history.

(56) References Cited

U.S. PATENT DOCUMENTS 391,185 A * 10/1888 Parker ..... G08B 5/00 116/319
937,264 A * 10/1909 Philbrick ..... G09F 7/00 40/492
1,410,402 A * 3/1922 Gray ..... G09F 3/16 40/659
1,552,729 A * 9/1925 Pipp ..... G09F 1/10 40/658
1,704,562 A * 3/1929 Egan ..... G09F 3/20 211/44
2,553,266 A * 5/1951 Myers ..... G08B 5/02 116/313
2,579,686 A * 12/1951 Mallory ..... G08B 5/02 116/319
3,109,634 A * 11/1963 Anson ..... B01F 13/002 116/2
3,132,628 A * 5/1964 Gehlsen ..... G08B 5/02 116/319

(Continued)

FOREIGN PATENT DOCUMENTS

CA 2654520 12/2006
DE 446848 C * 7/1927 ..... G08B 5/02
GB 172492 A * 12/1921 ..... G08B 5/02

OTHER PUBLICATIONS

At Your Service Flags, retrieved on Oct. 16, 2015, retrieved from http://www.apdesignsdirect.com/, 9 pages.

(Continued)

*Primary Examiner* — R. A. Smith
(74) *Attorney, Agent, or Firm* — Brian S. Steinberger; Law Offices of Brian S. Steinberger, P.A.

(57) ABSTRACT

Devices, apparatus, and methods for clamping a pivoting arm/flag onto an edge of furniture, such as a table edge, countertop edge, and the like, with or without messages and advertising indicia thereon, in order to signal servers and wait staff that service is being requested. The clamp can include a one-piece clip with a substantially horizontal top leg perpendicular to a top edge of a back panel, and an upwardly angled lower leg attached to a bottom edge of the back panel.

14 Claims, 19 Drawing Sheets

(56) References Cited

U.S. PATENT DOCUMENTS

| | | | | | |
|---|---|---|---|---|---|
| 3,810,164 | A * | 5/1974 | Lambert | G09F 23/04 | 340/332 |
| 4,563,381 | A | 1/1986 | Woodland | | |
| 4,728,069 | A | 3/1988 | Semcer | | |
| 4,794,877 | A * | 1/1989 | Pollard-Smith | G08B 5/00 | 116/321 |
| 5,260,914 | A * | 11/1993 | Roberts | G09F 11/23 | 116/308 |
| 5,355,115 | A | 10/1994 | Goor | | |
| 5,463,974 | A | 11/1995 | Seeder | | |
| 5,489,887 | A * | 2/1996 | Porras | G08B 7/068 | 340/286.09 |
| 5,504,976 | A * | 4/1996 | Reeves | A44C 3/001 | 24/3.1 |
| 5,524,856 | A | 6/1996 | Neely | | |
| 5,594,409 | A | 1/1997 | Shank | | |
| 6,014,942 | A * | 1/2000 | Perka et al. | G09F 17/00 | 116/173 |
| 6,299,111 | B1 | 10/2001 | Brothers | | |
| 6,366,196 | B1 | 4/2002 | Green | | |
| D486,385 | S | 2/2004 | Smith-Kielland et al. | | |
| 7,036,778 | B2 | 5/2006 | Ferrell | | |
| D557,296 | S | 12/2007 | Apodaca | | |
| 7,318,293 | B2 * | 1/2008 | Ardern, II | G09F 7/02 | 24/67.5 |
| 7,353,736 | B2 | 4/2008 | Poehlmann | | |
| D600,543 | S | 9/2009 | Coles | | |
| D603,781 | S | 11/2009 | Jimenez | | |
| D610,441 | S | 2/2010 | Jones | | |
| D638,287 | S | 5/2011 | Tedesco | | |
| 8,074,325 | B2 * | 12/2011 | Gerfast | B42F 1/06 | 24/67 R |
| D670,159 | S | 11/2012 | Bitarchas et al. | | |
| D670,160 | S | 11/2012 | Bitarchas et al. | | |
| D672,264 | S * | 12/2012 | Ochoa | D10/109.1 | |
| D679,176 | S | 4/2013 | Tedesco et al. | | |
| 8,430,052 | B2 | 4/2013 | Nihra | | |
| 8,548,856 | B2 | 10/2013 | Maruszak | | |
| D695,099 | S | 12/2013 | Maclellan et al. | | |
| D736,610 | S | 8/2015 | Rey | | |
| 2006/0279415 | A1 | 12/2006 | Solheim | | |
| 2007/0039542 | A1 * | 2/2007 | Schrauwen et al. | G09F 17/00 | 116/313 |

OTHER PUBLICATIONS

Hampshire Flag Company, retrieved from http://www.tableflags.co.uk/NationalTableFlags.htm, 2009, 1 page.

Fripp Design, retrieved from http://www.frippdesign.co.uk/problems-solved/table-flag/, 2014, 1 page.

Pancho's Mexican Buffet retrieved from http://en.wikipedia.org/wiki/Pancho's_Mexican_Buffett, 2014, 3 pages.

* cited by examiner

CLAMP AND PIVOTING FLAG FOR TABLES

FIELD OF INVENTION

This invention relates to the service industry for but not limited to; restaurants, diners, cafes, and bars, and in particular to devices, apparatus, and methods for clamping a pivoting arm or flag onto a table edge or counter top edge, with or without messages and advertising indicia thereon, in order to signal servers and wait staff.

BACKGROUND AND PRIOR ART

Many modern day service industry restaurants, diners, cafes, and bars are typically setup with waiters, waitresses, bartenders and of the such to provide service for the Patrons. In these establishments the need for service for the Patrons is not always noticed right away by the servers and waitstaff. On some occasions a Patron may have to catch a server's attention by verbal signals such as whistling, speaking loudly, or tapping glasses, or even hand signals physically motioning a server's attention and the like. While these techniques are well known, the signaling techniques can be time consuming and/or frustrating for the patrons, as well as potentially disruptive to other patrons.

More elaborate devices have been proposed over the years to help with notifying servers. See for example, U.S. Pat. No. 5,355,115 to Goor et al.; U.S. Pat. No. 5,594,409 to Shank; U.S. Pat. No. 6,366,196 to Green; U.S. Pat. No. 8,548,856 to Maruszak; and 2006/0279415 to Solheim. However, these devices require power supplies to operate and be an expensive supply for food service establishments that work on tight budgets.

Other more mechanical devices have been proposed such as using table top flags or placards. However, these loose devices can easily be dropped from the tabletops and not used over time.

Thus, the need exists for a simple and effective server notification device, etc. over the prior art.

SUMMARY OF THE INVENTION

A primary objective of the present invention is to provide devices, apparatus, and methods clamping a pivoting flag/arm onto a table edge, with or without messages and advertising indicia thereon, in order to signal servers and wait staff.

A secondary objective of the present invention is to provide mechanical attachable devices, apparatus, and methods attachable to table tops for signaling servers and wait staff.

A third objective of the present invention is to provide devices, apparatus, and methods clamping a pivoting flag/arm onto a countertop edges, with or without messages and advertising indicia thereon, in order to signal servers and wait staff.

A fourth objective of the present invention is to provide mechanical attachable devices, apparatus, and methods attachable to counter top edges for signaling servers and wait staff.

A preferred embodiment of a signaling device for notifying servers, can include a clamp having a front and a rear, the rear for attaching about an edge of a piece of furniture, and an articulating elongated member having a first end pivotally attached to the front of the clamp, and a second end which extends away from the first end, the elongated member having a first lowered position generally adjacent to an substantially covering across the front of the clamp, and a second raised position being substantially angled to the front of the clamp with the second end raised from the front of the clamp.

The clamp can include a one piece clip. The clamp and the elongated member can both be formed from plastic. The clamp and the elongated member can both be formed from metal. The clamp and the elongated member can also be formed from other materials, such as cardboard, and the like, as well as fiberglass, and the like, and combinations thereof.

The clip can include a top leg for fitting about an upper surface of the furniture edge, and a lower leg for fitting about a lower surface of the furniture edge.

The clip can further include a back panel having an upper edge and a lower edge, with the top leg attached substantially perpendicular to the upper edge of the back panel, and the lower leg attached at an upward angle from the bottom edge of the back panel.

The top leg can include a substantially flat planar member with outer convex curved edges.

The top leg can include a substantially flat planar member with outer tapered or beveled edges.

The clip can further include a hinge along the bottom edge of the back panel for allowing the lower leg to adjust to different clamp ranges about the edge on the piece of furniture.

The clip can clamp about an edge of furniture such as an outer edge of a table top. The clip can clamp about an edge of furniture such as an outer edge of a counter top.

The signaling device can include a catch for limiting travel of the articulating elongated member in the first lowered position to be substantially horizontal to the clamp.

The signaling device can include another catch for limiting travel of the articulating elongated member in the second position to be substantially perpendicular to the clamp.

The signaling device can include a male member mateably attached to a female member to allow for pivotally attaching the first end of the elongate member to the rear of the clamp.

The elongated member can include an elongated arm with the second end having a knurled surface designed to allow easy traction for a patron's finger. The elongated member can include an elongated arm with the first end having a convex curved surface.

The signaling device can include indicia such as messages and/or advertising on an outer exposed surface of the elongated member.

The signaling device can include indicia such as messages and/or advertising on an outer exposed surface of the front of the clamp.

Further objects and advantages of this invention will be apparent from the following detailed description of the presently preferred embodiments which are illustrated schematically in the accompanying drawings.

BRIEF DESCRIPTION OF THE FIGURES

First Embodiment

Second Embodiment

Figure 18:
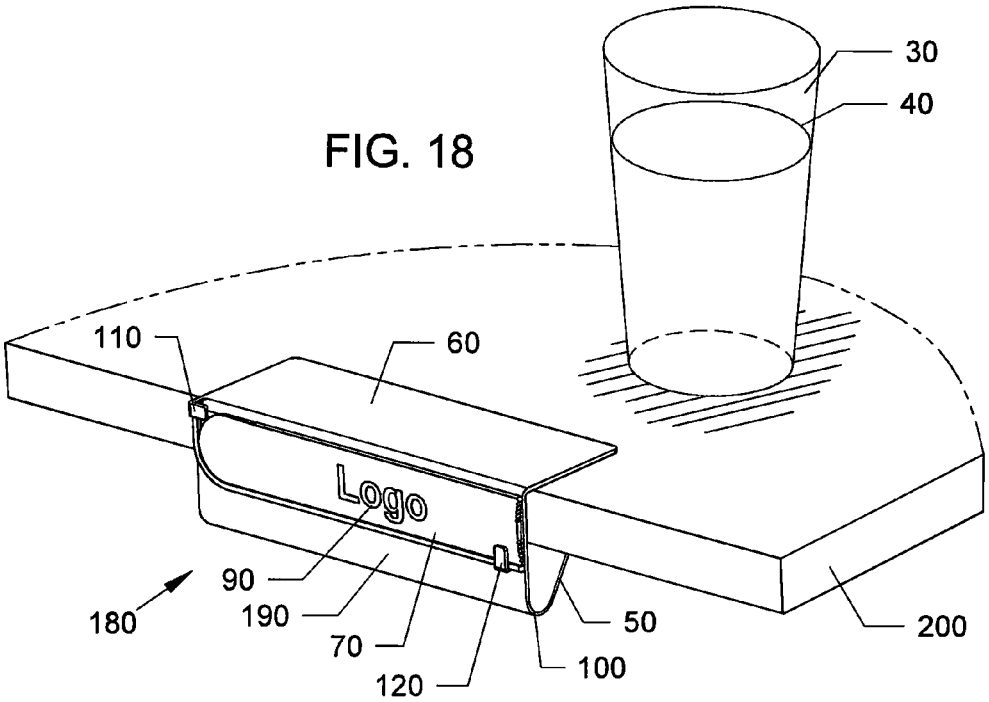

FIG. 18 is a top perspective view of another embodiment of the clamp with pivoting arm/flag clipped to a table edge for smaller thickness tables (approximately ⅞" to 1.5").

Figure 19:
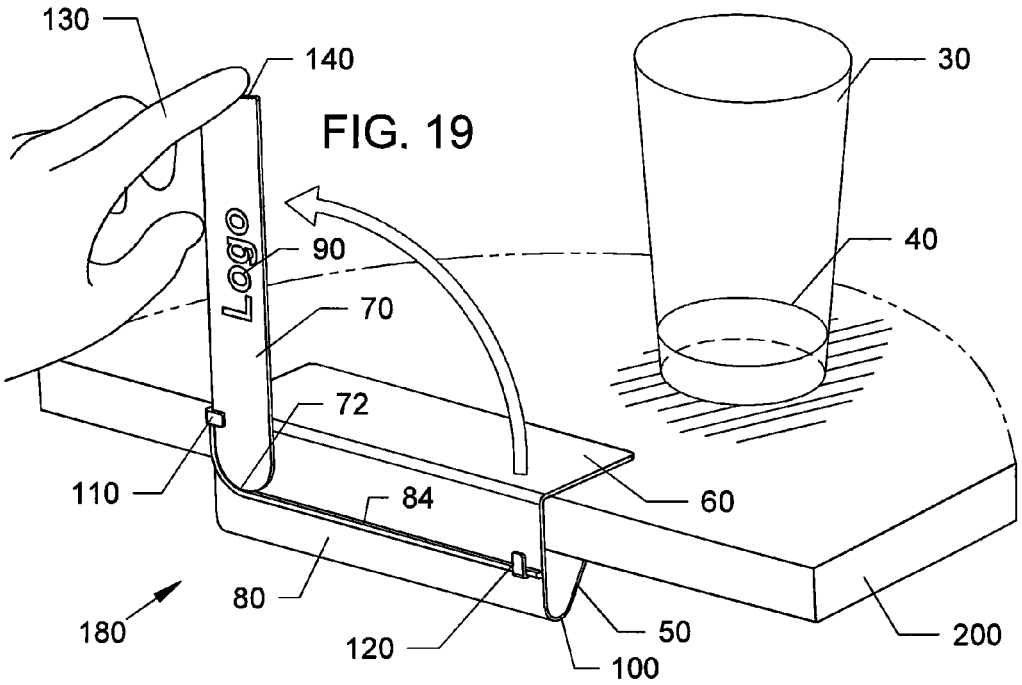

FIG. 19 is another perspective view of the clamp with pivoting arm/flag clipped to a table edge of FIG. 18 with the arm/flag being raised.

Figure 20:
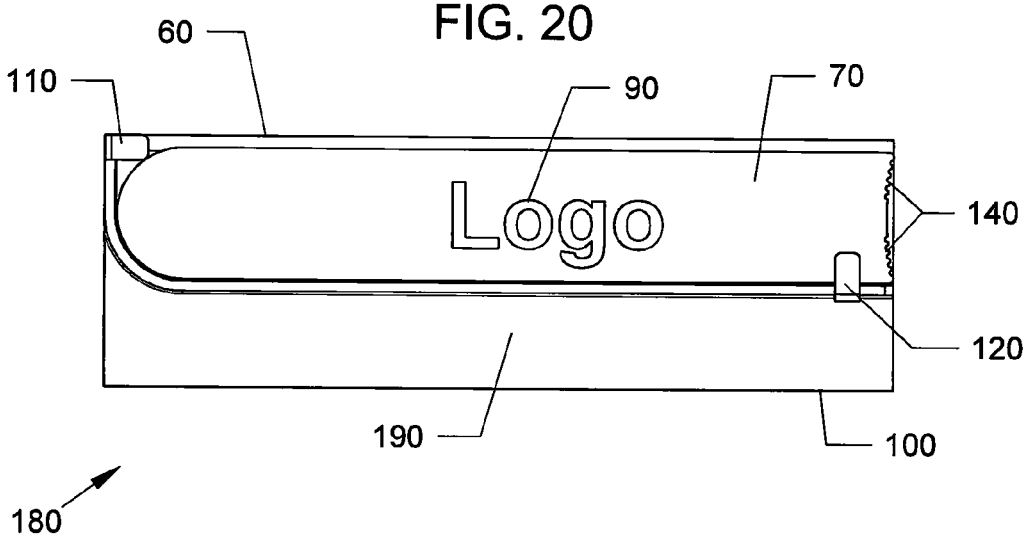

FIG. 20 is a front view of the clamp with pivoting arm/flag of FIG. 19 with arm/flag in lowered closed position.

Figure 21:
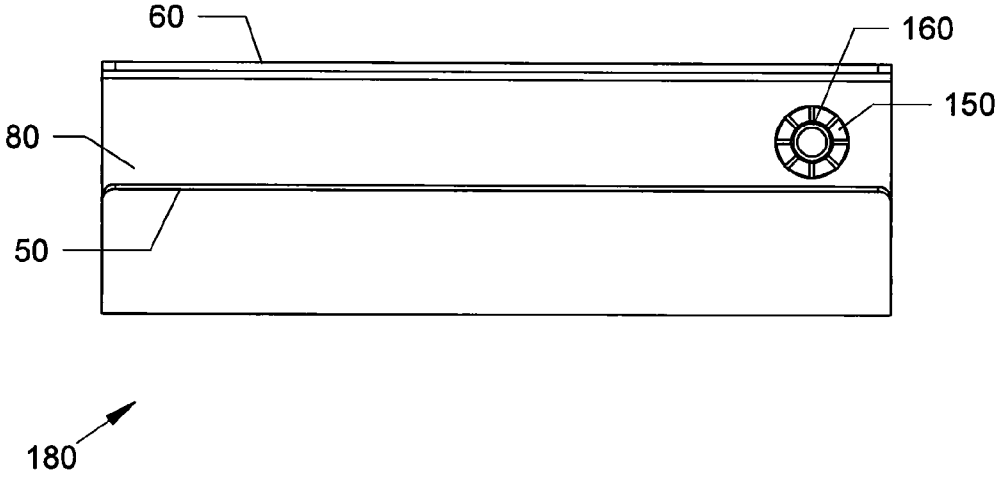

FIG. 21 is a rear view of the clamp with pivoting arm/flag of FIG. 20.

Figure 22:
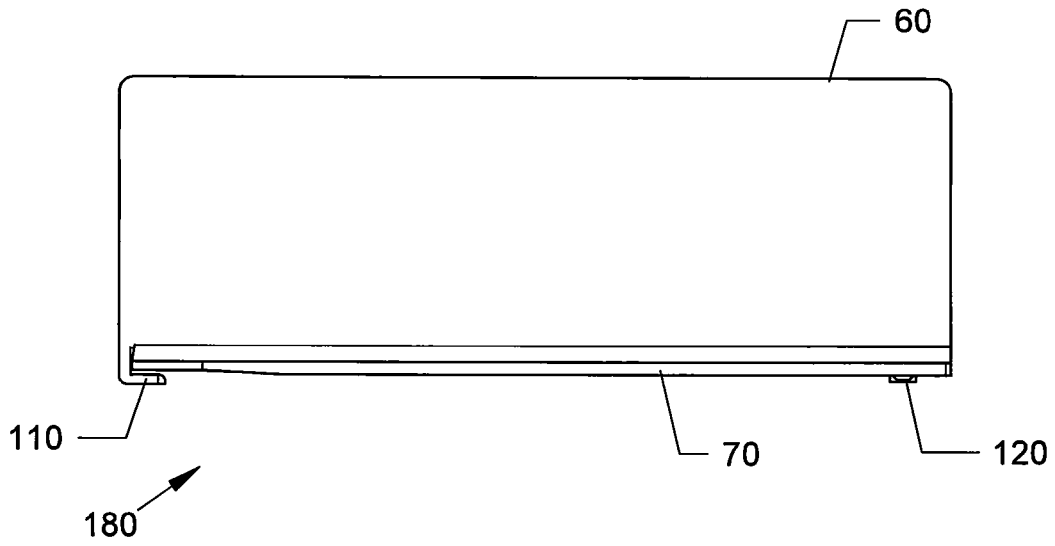

FIG. 22 is a top view of the clamp with pivoting arm/flag of FIG. 20.

Figure 23:
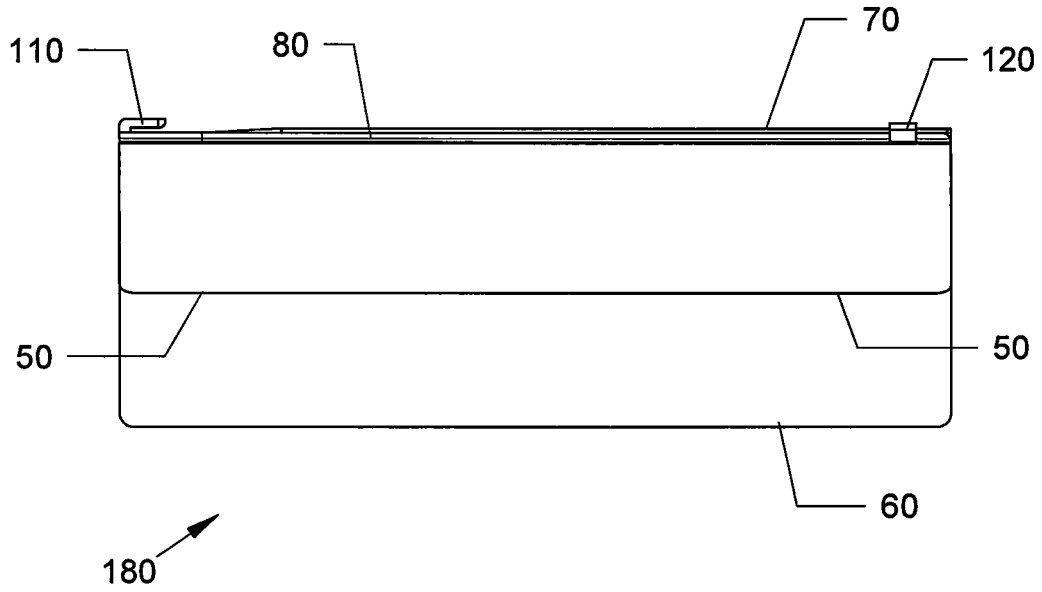

FIG. 23 is a bottom view of the clamp with pivoting arm/flag of FIG. 20.

Figure 24:
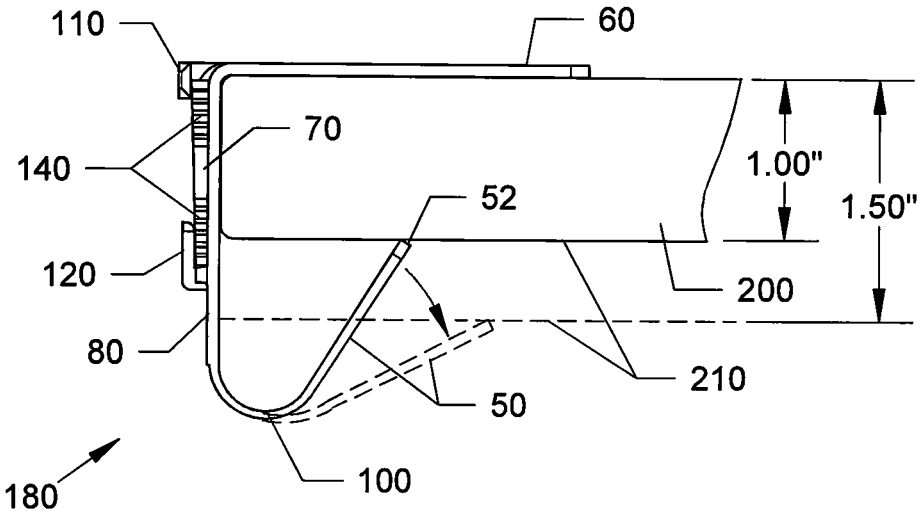

FIG. 24 is a right side view of the clamp with pivoting arm/flag of FIG. 20 clipped to a table edge shown n FIG. 18.

Figure 25:
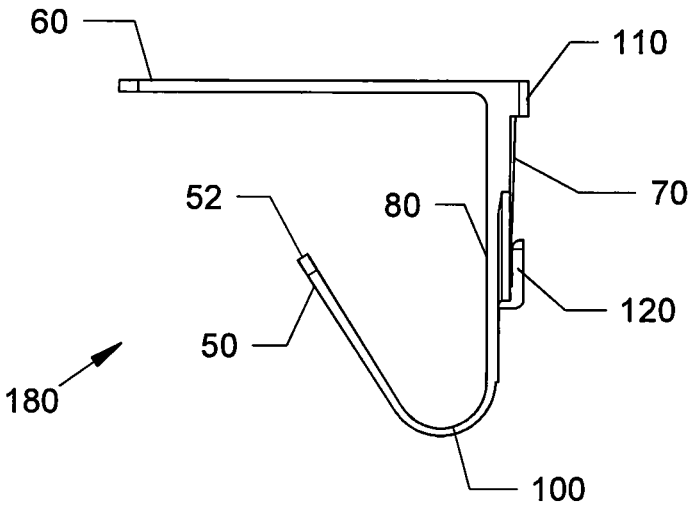

FIG. 25 is a left side view of the clamp with pivoting arm/flag of FIG. 20.

Third Embodiment

Figure 26:
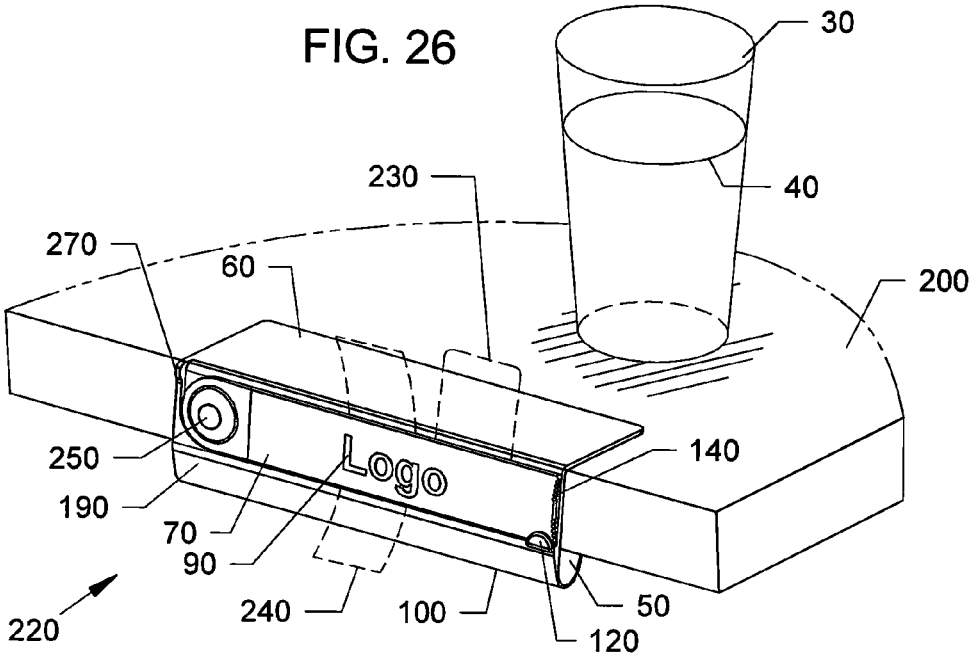

FIG. 26 is a top perspective view of another embodiment of the clamp with pivoting arm/flag with a pivoting pin locking plug attaching the arm/flag to the assembly clipped to a table edge with arm/flag in the down position.

Figure 27:
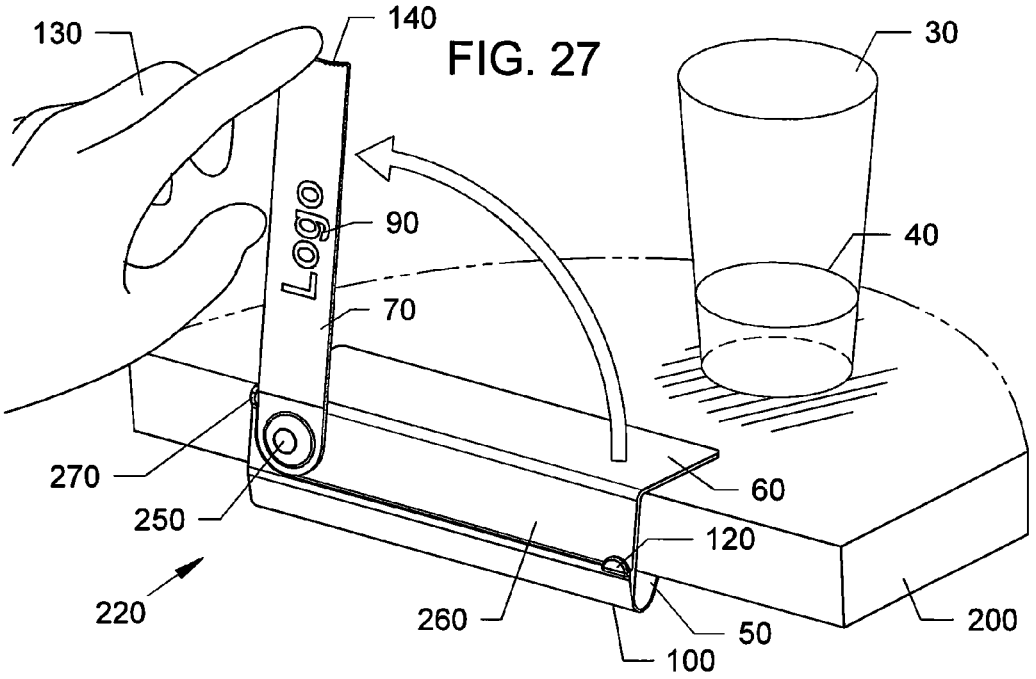

FIG. 27 is another view of the clamp with pivoting arm/flag of FIG. 26 with arm/flag raised to an up open position.

Figure 28:
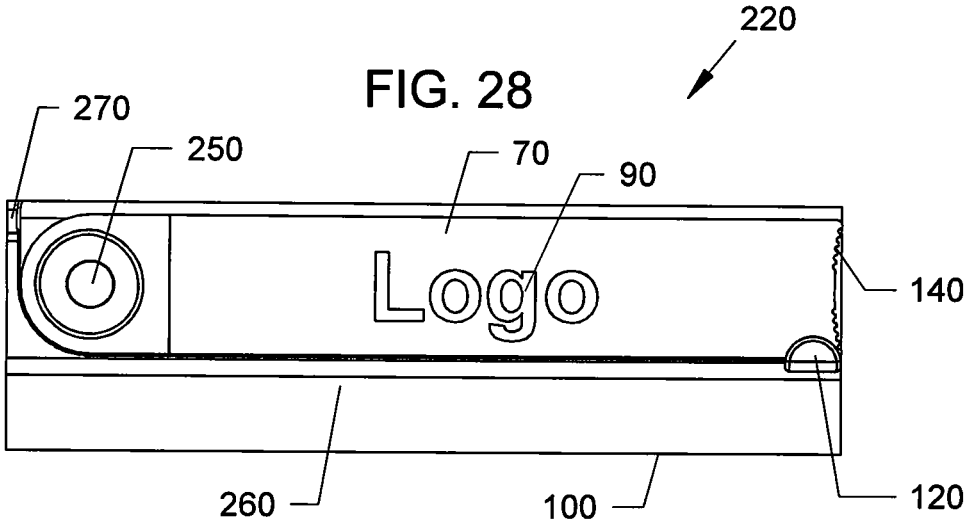

FIG. 28 is a front view of the clamp with pivoting arm/flag with a pivoting pin locking plug attaching the arm/flag to the assembly.

Figure 29:
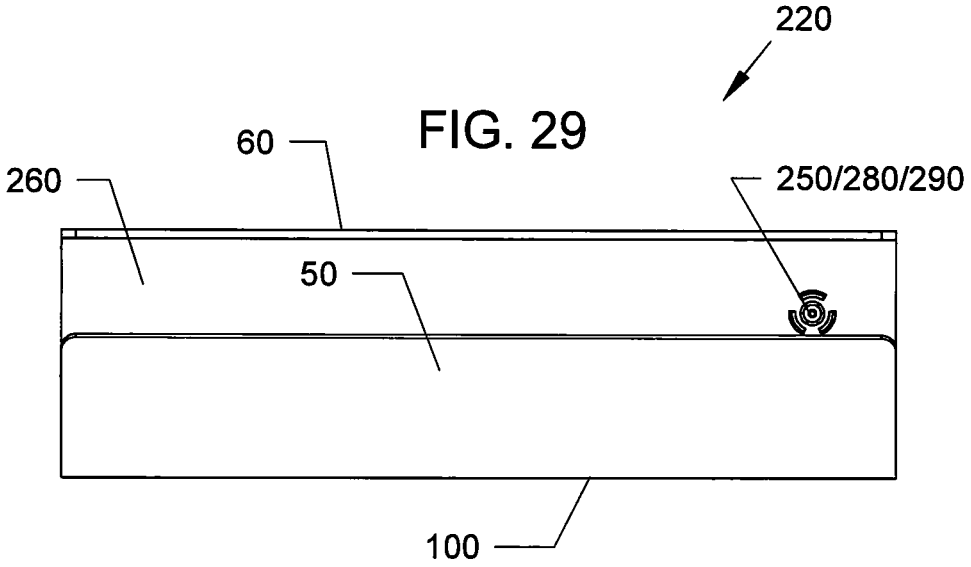

FIG. 29 is a rear view of the clamp with pivoting arm/flag of FIG. 28.

Figure 30:
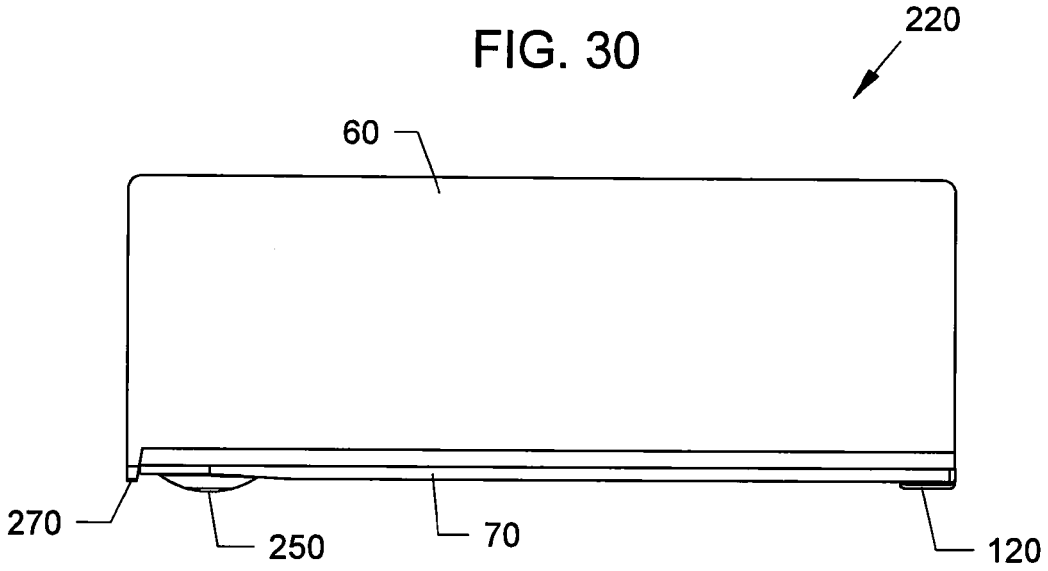

FIG. 30 is a top view of the clamp with pivoting arm/flag of FIG. 28.

Figure 31:
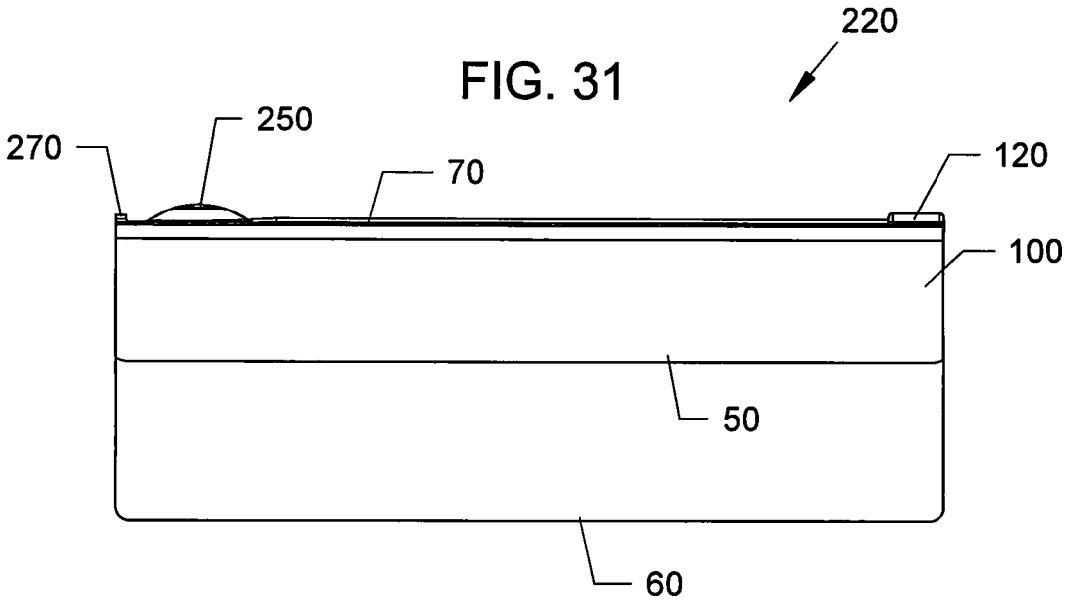

FIG. 31 is a bottom view of the clamp with pivoting arm/flag of FIG. 28.

Figure 32:
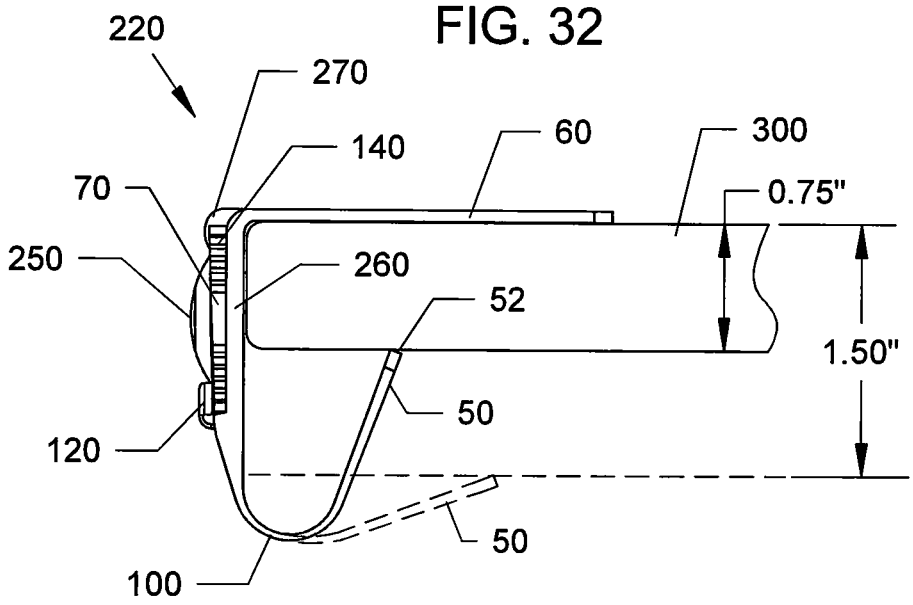

FIG. 32 is a right side view of the clamp with pivoting arm/flag of FIG. 28 clipped onto a table edge.

Figure 33:
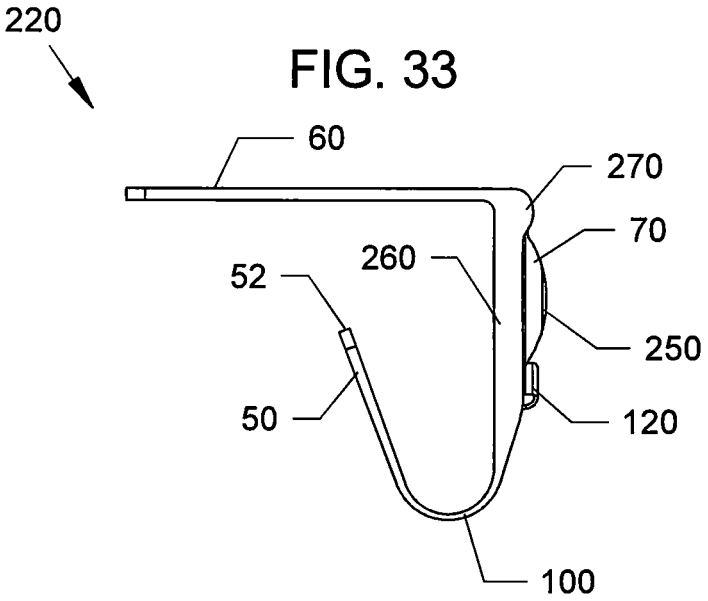

FIG. 33 is a left side view of the clamp with pivoting arm/flag of FIG. 28.

Figure 34:
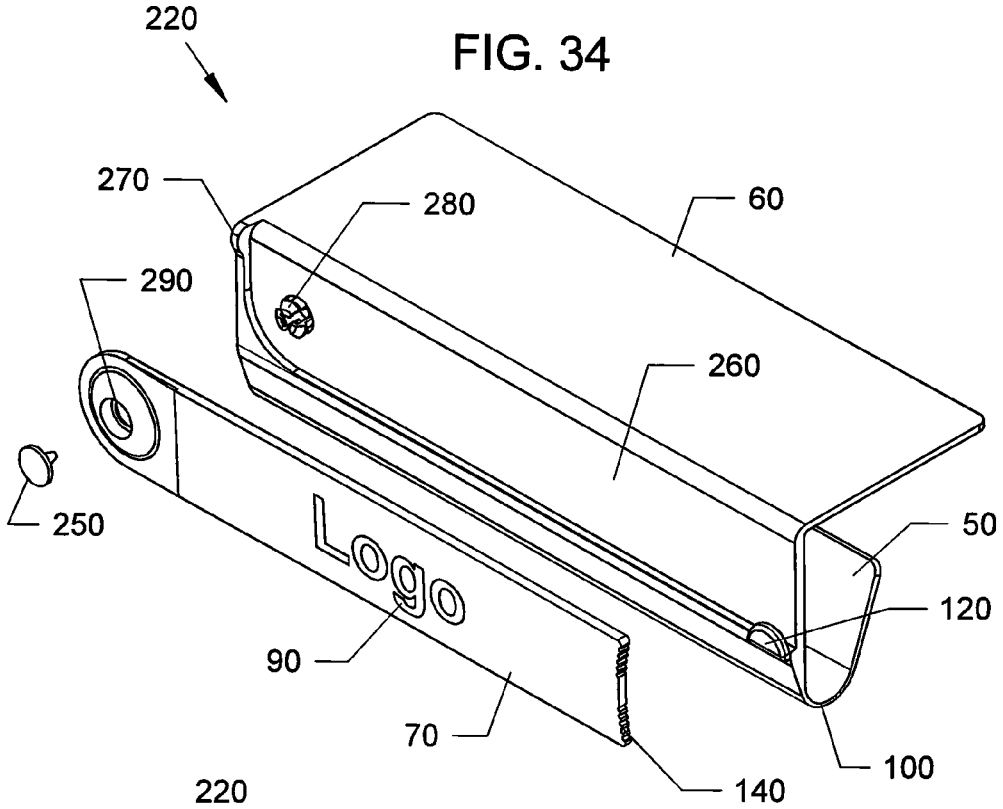

FIG. 34 is an exploded front perspective view of the clamp with pivoting arm/flag of FIG. 28 with arm/flag separated from the assembly.

Figure 35:
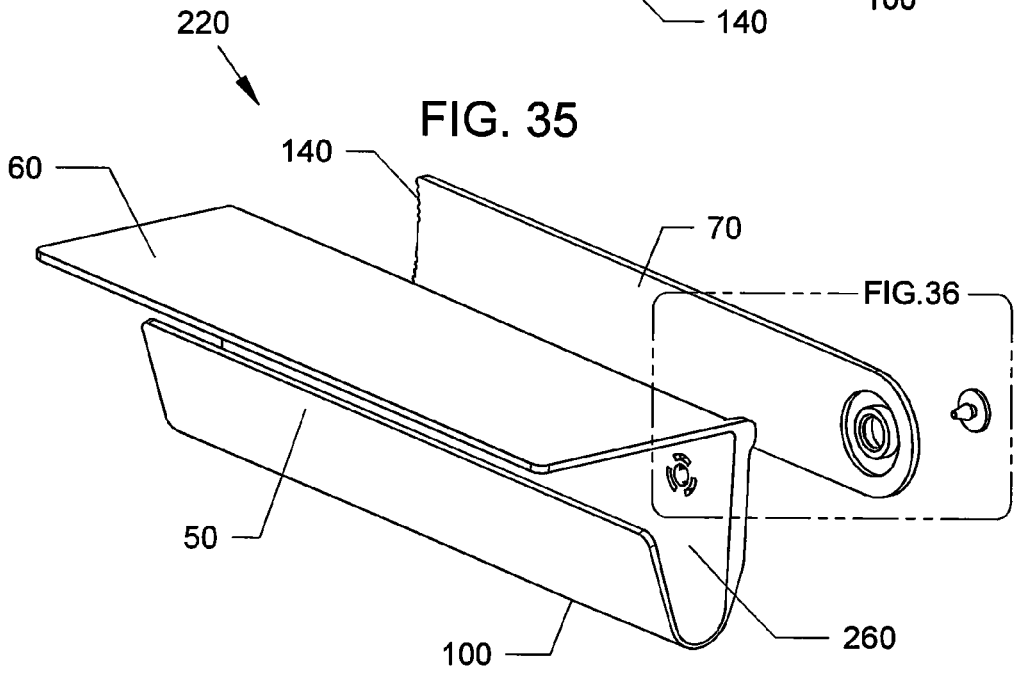

FIG. 35 is an exploded rear perspective view of the clamp with pivoting arm/flag shown in FIG. 34 with arm/flag separated from the assembly.

Figure 36:
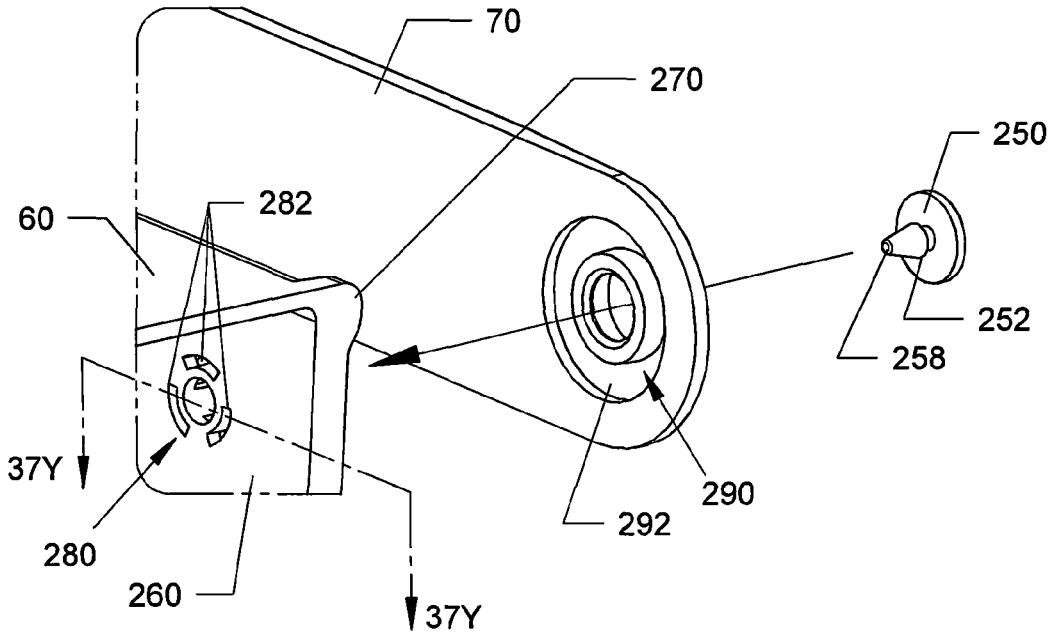

FIG. 36 is an enlarged rear perspective view of the pivot pin snap feature in the assembly spaced from the arm/flag and pivot pin.

Figure 37:
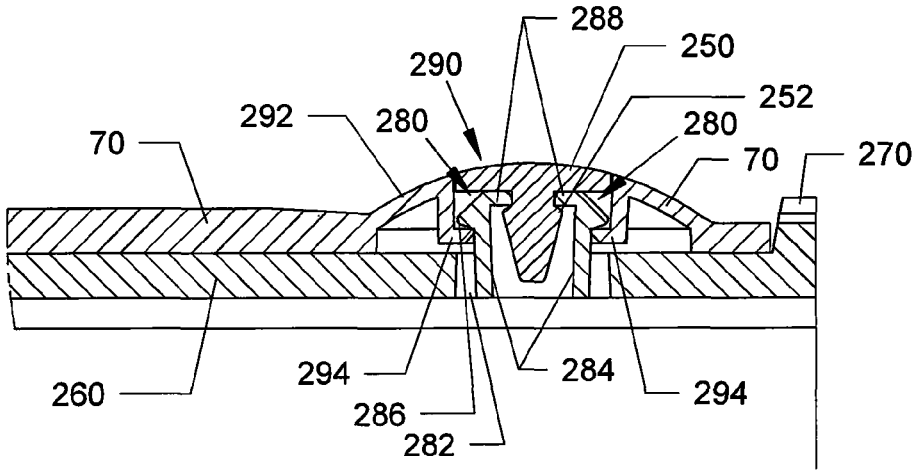

FIG. 37 is a cross-sectional view of the arm/flag attached to the assembly along arrows 37Y shown in FIG. 36.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation. In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

10 Server flag assembly for 1.5" to 2.25" thick tables.
20 Table, 1.5" to 2.25" thick.
30 Beverage serving glass.
40 Beverage fill level.
50 Flexible clamp leg.

52 Outer edge
60 Rigid clamp leg.
62 Outer edge
64 side edge
70 Articulating arm/flag.
72 Convex curved lower end
80 Rigid clamp back panel for server flag assembly (10).
82 Curved ledge
84 Horizontal ledge
90 Advertising text and/or graphics printed or molded onto back panel (80).
100 Flexible clamp hinge.
110 Flag up support clip.
120 Flag down support clip.
130 Restaurant patrons hand raises flag (70).
140 Grip knurl located on the end of the server flag (70).
150 Female pivot snap located on rigid clamp back panel (80).
152 separate tabs
155 cut-out opening
160 Male pivot snap located on server flag (70).
162 outer extending wider ridge
170 Clamp range of server flag assembly (10).
180 Server flag assembly for ⅞" to 1.5" thick tables.
190 Rigid clamp back panel for server flag assembly (180).
200 Table, ⅞" to 1.5" thick
210 Clamp range of server flag assembly (180).
220 Universal server flag assembly embodiment.
230 Credit card (Prior Art).
240 Restaurant sales receipt/check.
250 Pivot pin locking plug.
252 Catch edge
258 Tapered tip
260 Rigid back panel for universal serving flag assembly.
270 Flag-up pivot stop.
280 Pivot pin male snap feature.
282 Arc cut-outs
284 Raised tabs 284
286 Outwardly protruding portions
288 Inwardly protruding portions
290 Pivot female snap feature.
292 Dome
294 Inner circumferential ledge

First Embodiment

FIGS. 1-17 cover the novel clamp with pivoting arm/flag with a clamping thickness of approximately 1½" to approximately 2¼" using a hidden pin connection.

Figure 1:
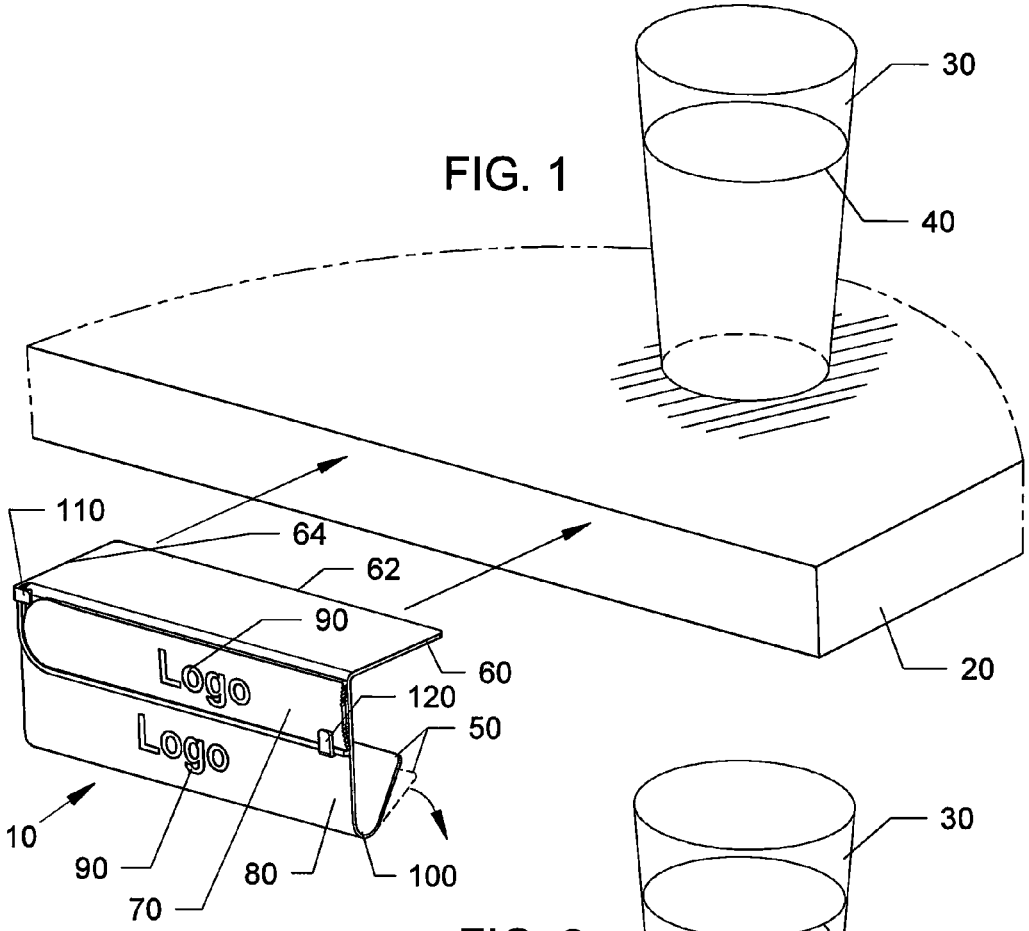
FIG. 1 is a perspective exploded view of the novel clamp with pivoting arm/flag assembly in position to clip onto an edge of a table.
Figure 2:
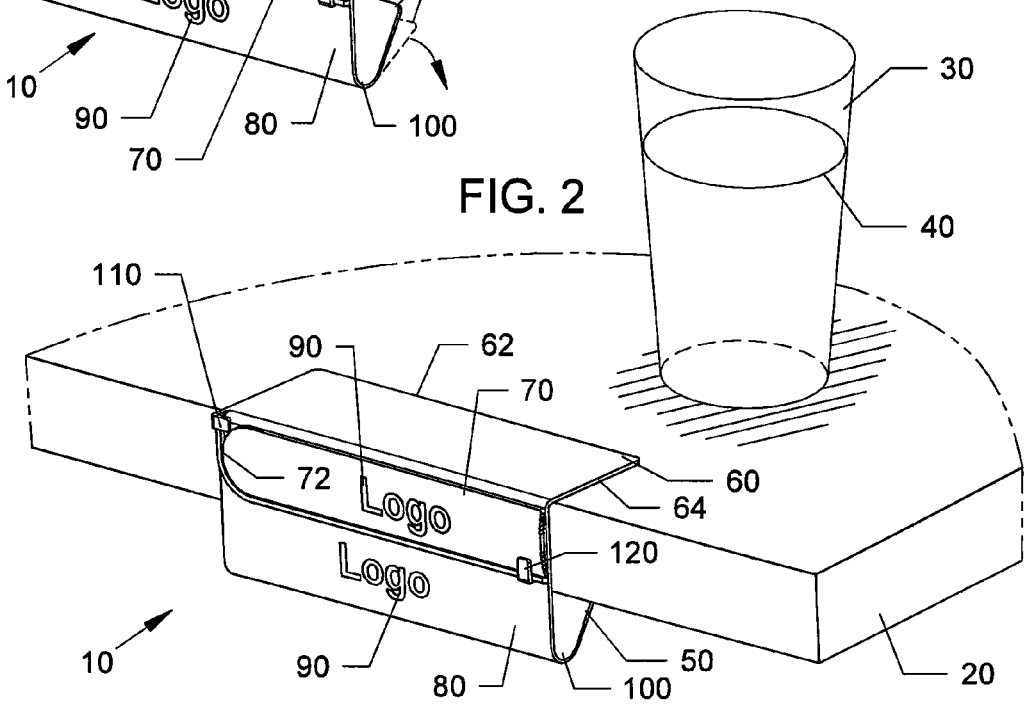
FIG. 2 is another perspective view of the clamp with pivoting arm/flag assembly clipped onto table edge.

FIG. 1 is a perspective exploded view of the novel clamp with pivoting arm/flag assembly 10 in position to clip onto an edge of a table 20. FIG. 2 is another perspective view of the clamp with pivoting arm/flag assembly 10 clipped onto the edge of the table 20.

Referring to FIGS. 1-2, assembly 10 can be used with tables having a thickness of approximately 1.5" to approximately 2.25". The assembly 10 can include a top generally rigid flat planar clamp leg 60 and a lower generally flexible clamp leg 50 that can have a tip edge which can abut against a bottom of the table top. The top generally rigid flat planar leg 60 can generally be flush against a top surface of the table 20. Here, the glass 30 is shown full of liquid 40 so no service from a waitress or other wait staff is required so the arm/flag 70 is in a down(closed) position.

Figure 3:
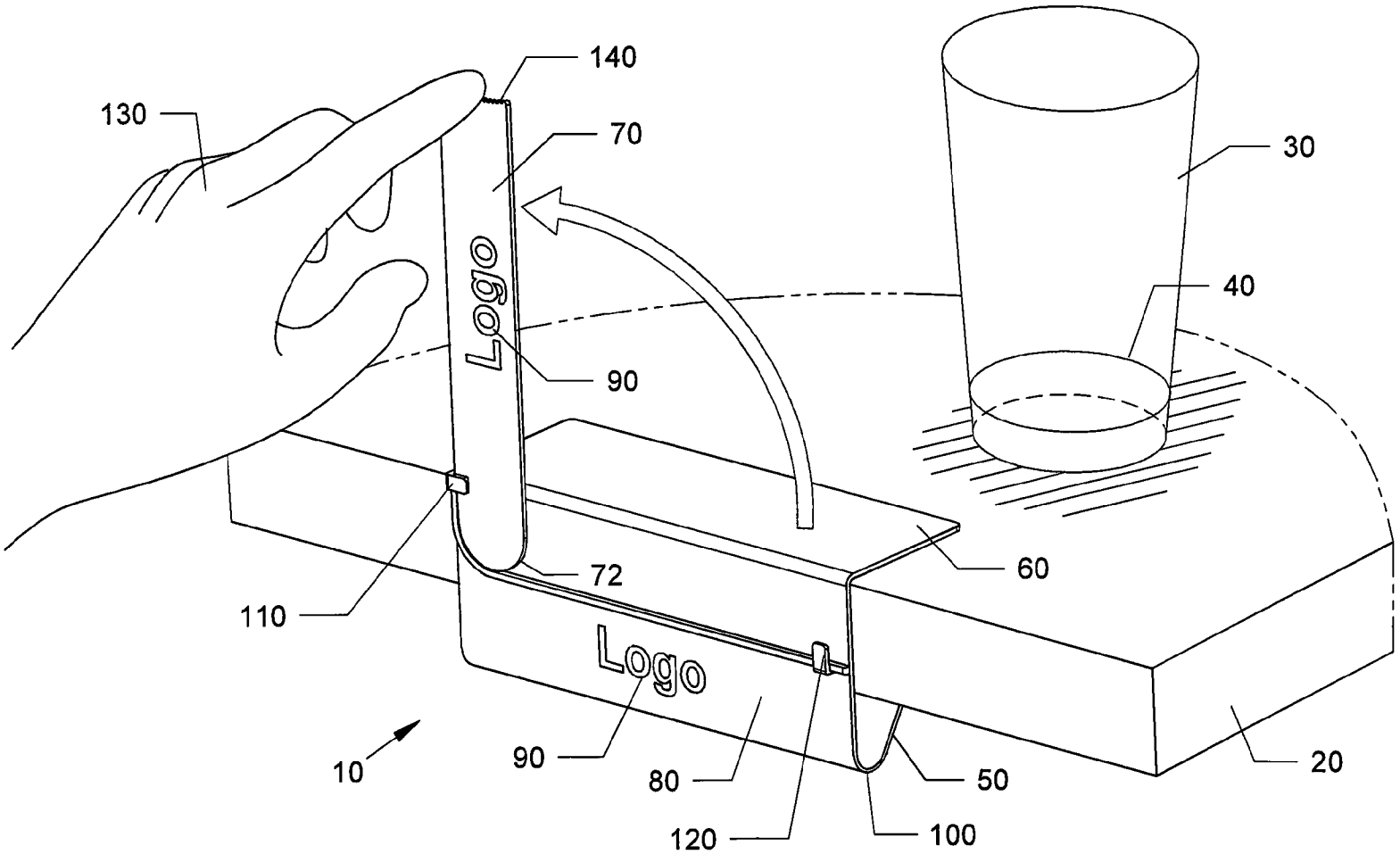
FIG. 3 is another perspective view of the clamp with pivoting arm/flag assembly clipped onto table edge of FIG. 2 with arm/flag raised to an up position.

FIG. 3 is another perspective view of the clamp with pivoting arm/flag assembly 10 clipped onto the edge of the table 20 of FIG. 2 with arm/flag 70 being articulated by at one end to be raised to an up position. Here, a patron can use a finger on their hand 130 placed on the grip knurl 140 at the outer end of the arm/flag 70 to raise the arm/flag thereby alerting the server that service is desired.

Figure 4:
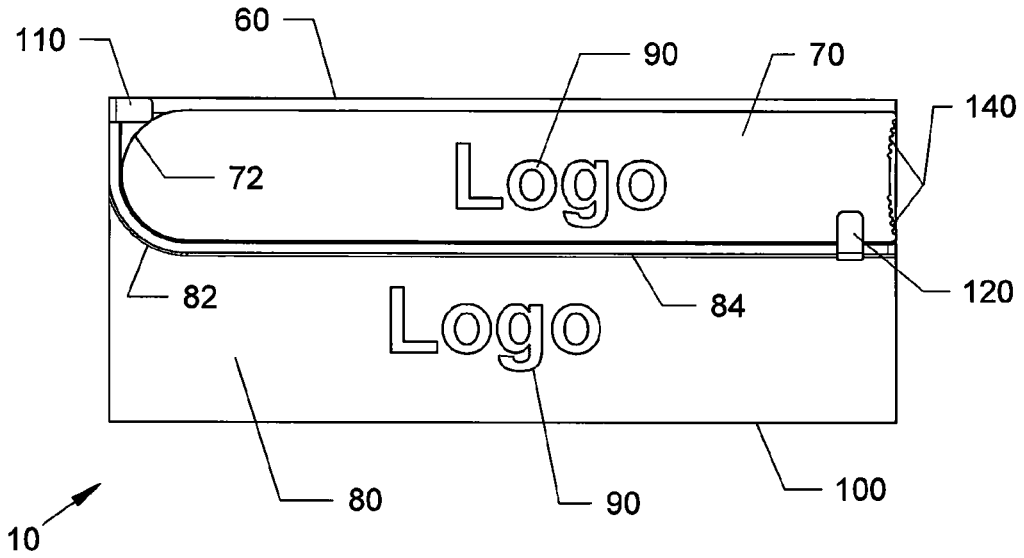
FIG. 4 is a front view of the clamp with pivoting arm/flag assembly of the preceding figures with the arm/flag in a down(closed) position.
Figure 5:
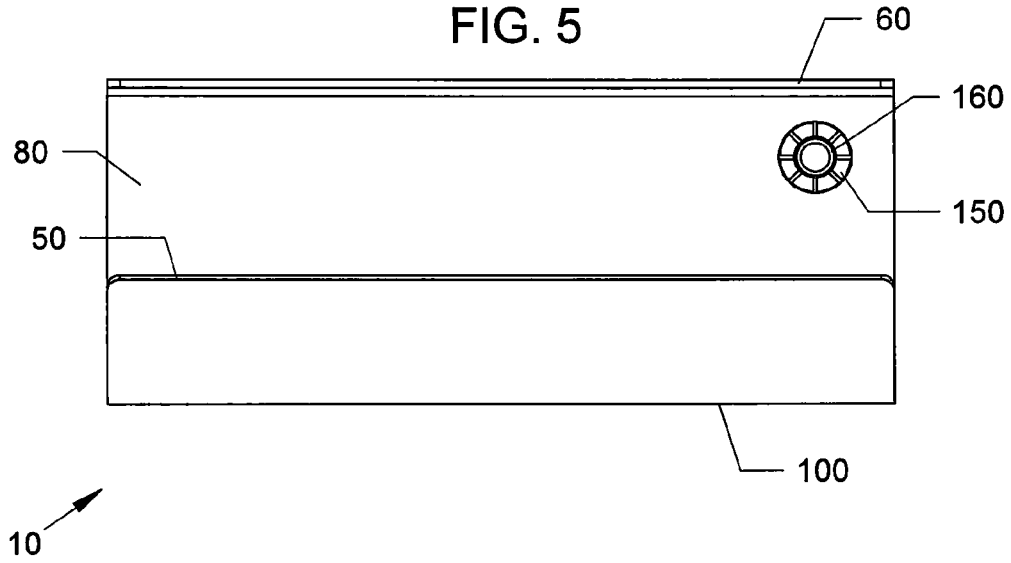
FIG. 5 is a rear view of the clamp with pivoting arm/flag assembly of FIG. 4.
Figure 6:
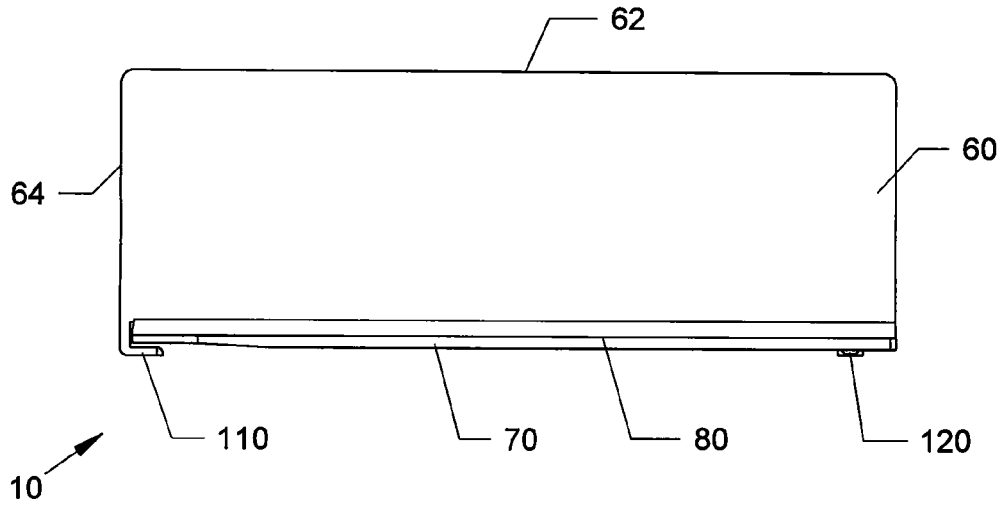
FIG. 6 is a top view of the clamp with pivoting arm/flag assembly of FIG. 4.
Figure 7:
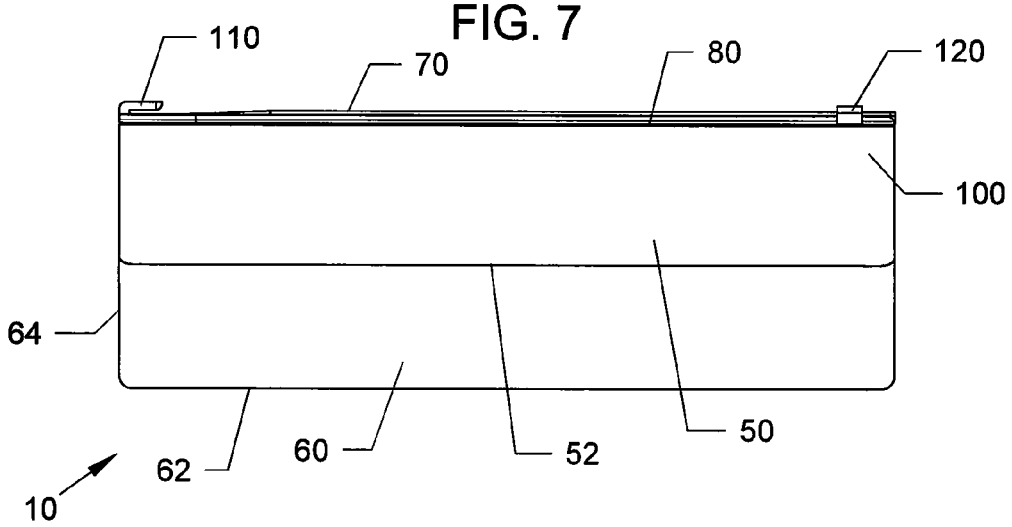
FIG. 7 is a bottom view of the clamp with pivoting arm/flag assembly of FIG. 4.
Figure 8:
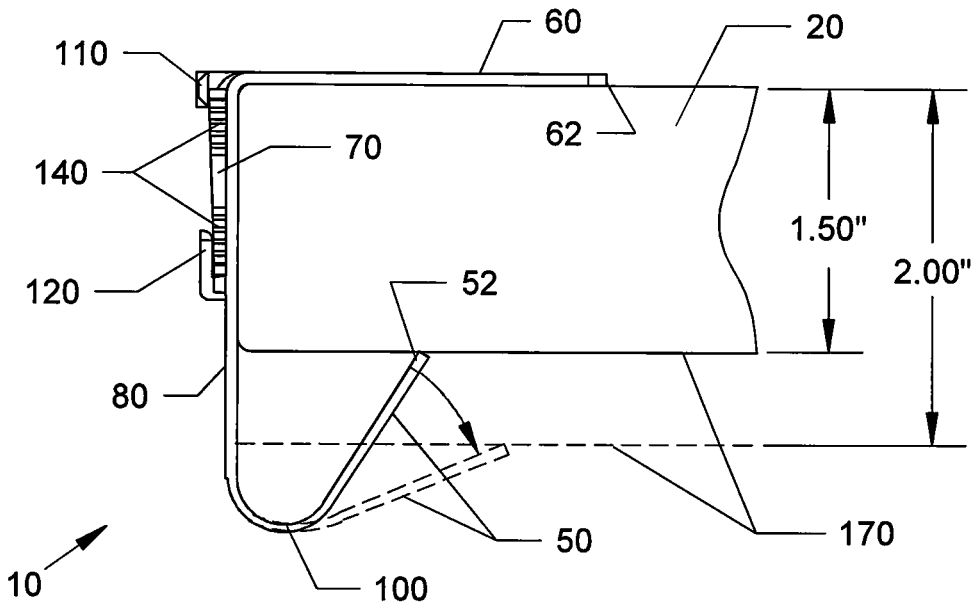
FIG. 8 is a right side view of the clamp with pivoting arm/flag assembly of FIG. 4 clamped to a table edge as shown in FIG. 1.
Figure 9:
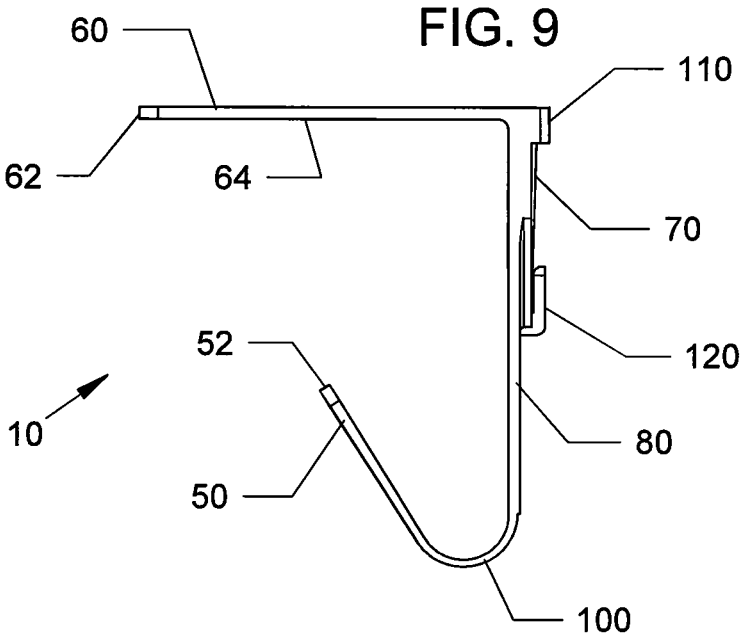
FIG. 9 is a left side view of the clamp with pivoting arm/flag assembly of FIG. 4.
Figure 10:
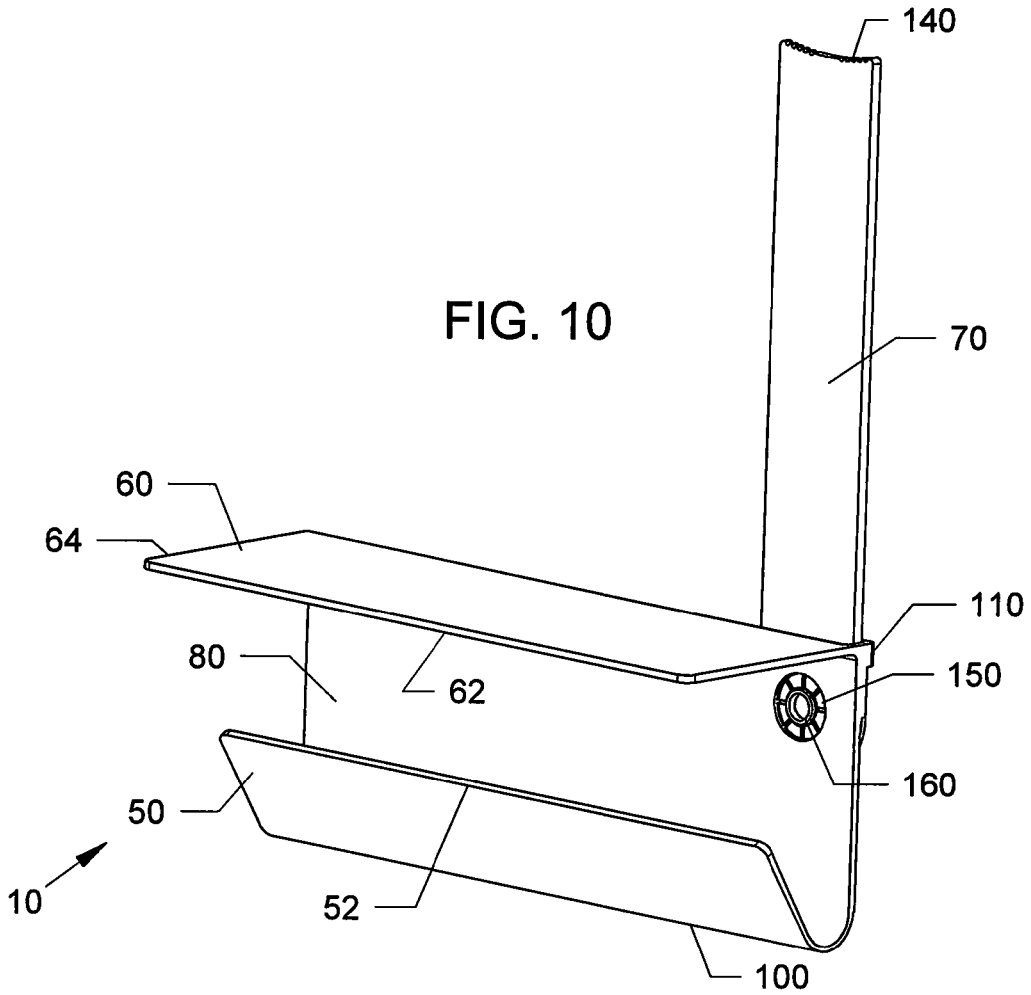
FIG. 10 is a rear perspective view of the clamp with pivoting arm/flag assembly shown in FIG. 4 with arm/flag in raised up(open) position.
Figure 11:
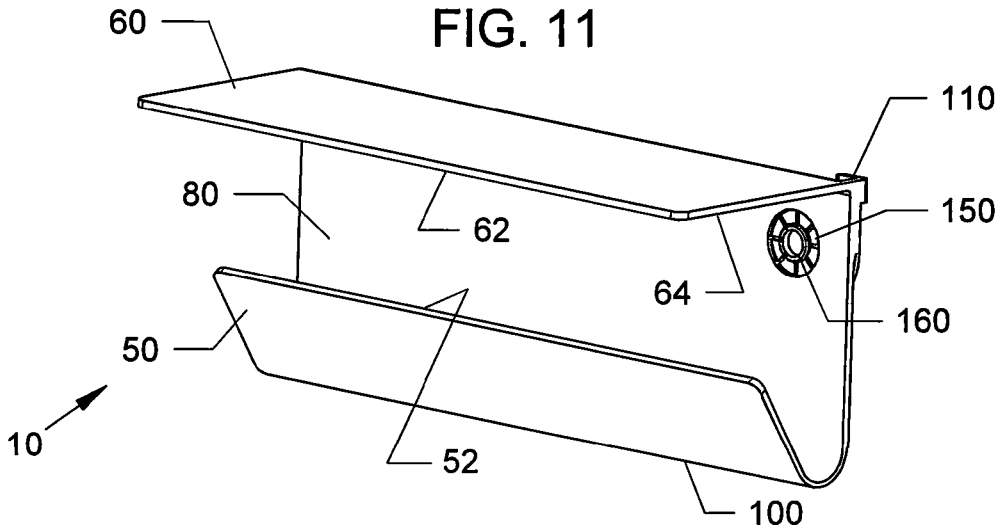
FIG. 11 is another rear perspective view of the clamp with pivoting arm/flag assembly shown in FIG. 4 is arm/flag in down lowered(closed) position.

FIG. 4 is a front view of the clamp with pivoting arm/flag assembly 10 of the preceding figures with the arm/flag 70 in a down (closed) position. FIG. 5 is a rear view of the clamp with pivoting arm/flag assembly 10 of FIG. 4. FIG. 6 is a top view of the clamp with pivoting arm/flag assembly 10 of FIG. 4. FIG. 7 is a bottom view of the clamp with pivoting arm/flag assembly 10 of FIG. 4. FIG. 8 is a right side view of the clamp with pivoting arm/flag assembly 10 of FIG. 4 clamped to an edge of a table 20 as shown in FIG. 1. FIG. 9 is a left side view of the clamp with pivoting arm/flag assembly 10 of FIG. 4. FIG. 10 is a rear perspective view of the clamp with pivoting arm/flag assembly 10 shown in FIG. 4 with arm/flag 70 in raised up(open) position. FIG. 11 is another rear perspective view of the clamp with pivoting arm/flag assembly 10 shown in FIG. 4 is arm/flag 70 in down lowered(closed) position.

In this embodiment, the front (entire back panel 80 dimensions) of the assembly 10 can include a width of approximately 6", and an overall height of approximately 2.5", with the arm/flag 70 having a length of approximately 6" and a width of approximately 1". The upper leg 60 can have a length of approximately 6 inches and a depth of approximately 2". The space between the upper leg 60 and the outer edge 52 of the lower leg 50 can be approximately 1.50" at rest with a extending distance of approximately 2.25" with the clamp range 170 between these values as shown in FIG. 8. The hinge 100 can have an R value of approximately R.250. The lower leg 50 outer edge 52 can be spaced from the back panel 80 by approximately 1".

Referring to FIGS. 1-11, the assembly 10 can include the arm/flag 70 having one end pivotally attached to an upper left side portion of a rigid clamp back panel 80. Lower convex curved end 72 of arm/flag can rotate about convex curved ledge on back panel 80 to rest in a horizontal position adjacent to horizontal ledge 84. Support clip 110 along left side edge of the front face of back panel 80 can function as a stop to limit the raised position of arm/flag 70 to a generally vertical position. Another support clip 120 on the front right side of the back panel 80 adjacent to horizontal ledge 84 can function as a stop to limit the down lowered position of arm/flag 70.

Various indicia 90, such as messages (such as but not limited to service please), advertisements, and the like, can be placed on the front of the arm/flag 70 and/or on the lower front exposed face of the back panel 80. Additional indicia can be placed on the front face of the back panel 80 that only becomes exposed from the arm/flag 70 is in a raised up vertical position.

The back panel 80 and upper horizontal clamp leg 60 and lower flexible clamp leg 50 can be formed from a single piece of plastic, such as molded plastic, and the like.

The upper horizontal clamp leg 60 can be generally perpendicular to the back panel 80, and the lower leg 50 can angled upward from a flexible clamp hinge 100 area where the lower leg 50 meets the bottom of the back panel 80. The flexible clamp hinge 100 allows for bending the lower leg 50 to different table thicknesses between approximately 1.5" to approximately 2.25". When clipped in place, the outer edge 52 of lower leg abuts against a bottom surface portion of the table 20.

The perimeter outer edge 62 and side edges 64 of the upper horizontal clamp leg 60 can be additionally be convex rounded to narrow tips and/or beveled so that someone wiping the top of table 20 can slide a wipe cloth/towel over the outer edges 62, 64 of the upper flat leg 60 and not end up pushing the entire assembly 10 off the table 20, and also not cause any grime and/or debris to be swept underneath the upper clamp leg 60. The upper clamp leg 60 can also be made to be flush against the upper top surface of the table 20.

In operation, the assembly 10 can be used with outer edges of tables 20 having flat outer sides or convex curved outer side edges which can abut against a rear surface portion of the back panel 80.

Figure 12:
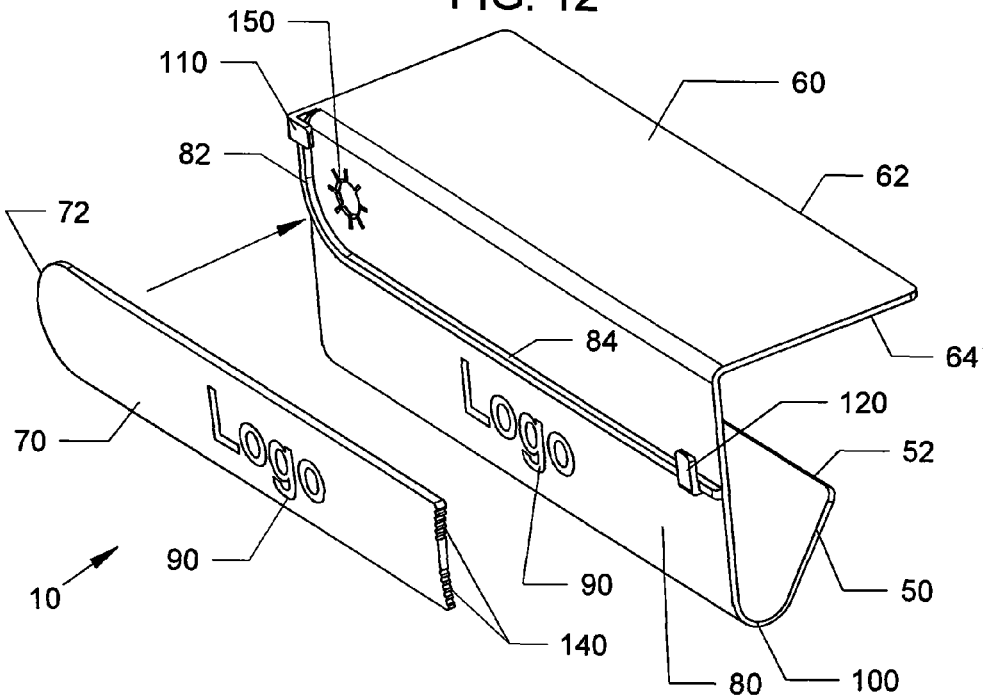
FIG. 12 is an exploded front perspective view the clamp with pivoting arm/flag assembly shown in FIG. 4 with arm/flag separated from the assembly.
Figure 13:
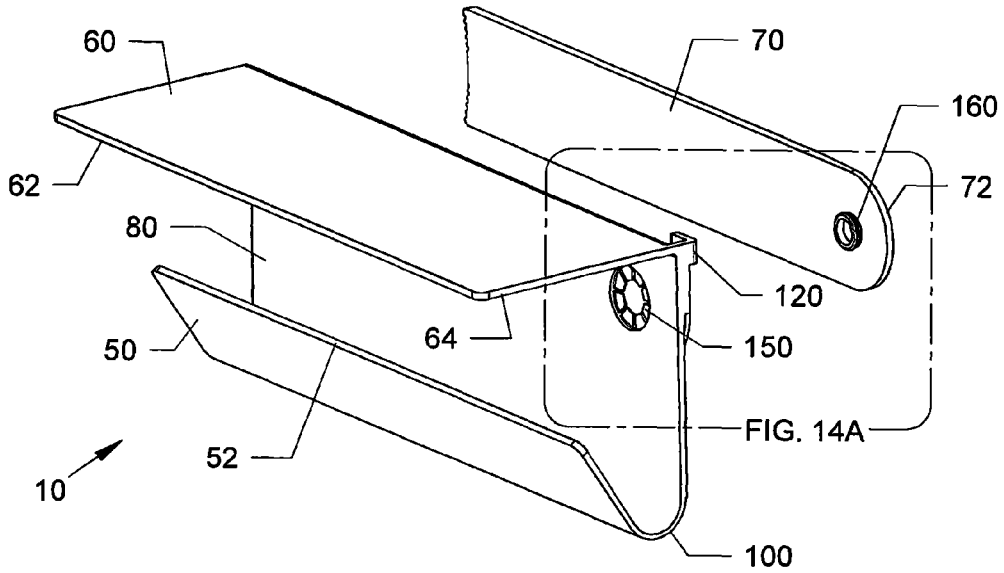
FIG. 13 is an exploded rear perspective view of the clamp with pivoting arm/flag assembly shown in FIG. 12 with arm/flag separated from the assembly.
Figure 14A:
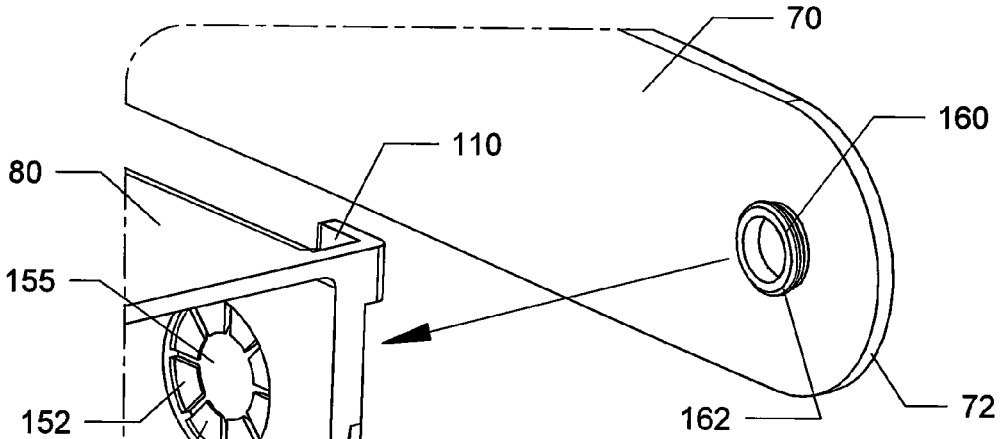
FIG. 14A is an enlarged view of the female pivot snap of the assembly spaced from the male pivot snap on the arm/flag shown in FIG. 13.
Figure 14B:
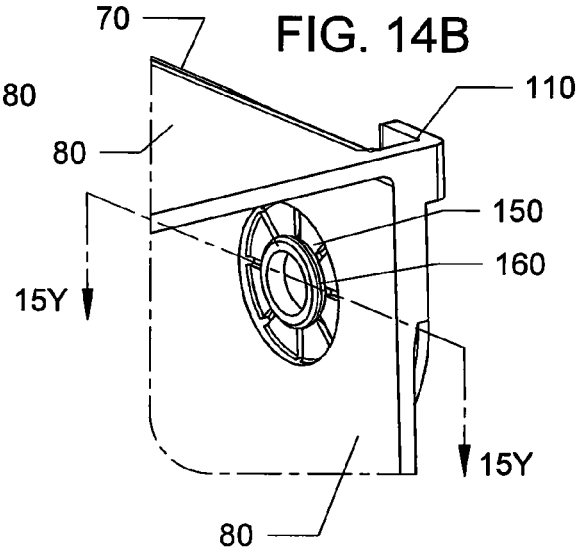
FIG. 14B is another enlarged view of the female pivot snap of the assembly attached to the male pivot snap on the arm/flag shown in 14A.
Figure 15:
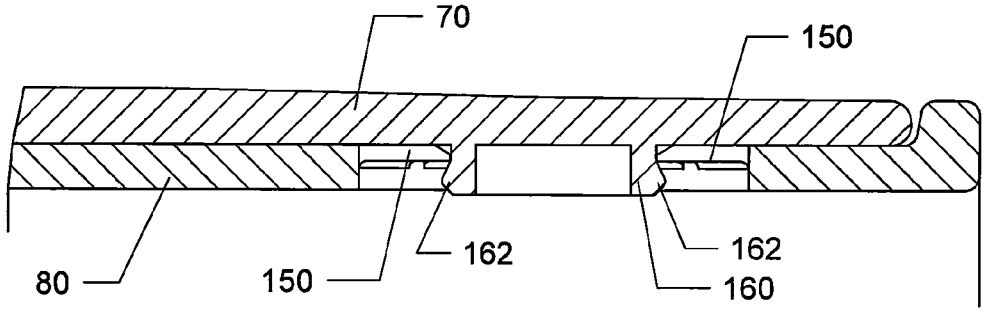
FIG. 15 is a cross-sectional view of the arm/flag attachment to the assembly shown in FIG. 14B along arrows 15Y.

FIG. 12 is an exploded front perspective view the clamp with pivoting arm/flag assembly 10 shown in FIG. 4 with arm/flag 70 separated from the assembly 10. FIG. 13 is an exploded rear perspective view of the clamp with pivoting arm/flag assembly 10 shown in FIG. 12 with arm/flag 70 separated from the assembly 10. FIG. 14A is an enlarged view of the female pivot snap 150 of the assembly spaced from the male pivot snap 160 on the arm/flag 70 shown in FIG. 13. FIG. 14B is another enlarged view of the female pivot snap 150 of the assembly 10 attached to the male pivot snap 160 on the arm/flag 70 shown in 14A, FIG. 15 is a cross-sectional view of the arm/flag 70 attachment points to the assembly 10 shown in FIG. 14B along arrows 15Y.

Referring to FIGS. 1-15, a male pivot snap 160 can be formed on an inner side portion of the arm/flag 70, and have a generally hollow ring shape with wider outer perimeter ridge 162 that protrudes outward from the rest of the ring shape of the male snap 160. The female pivot snap 150 can have a central opening cut-out 155, surrounded by a plurality of cut tabs 152, each having a base wider than the distal end which is about the opening 155. Pushing the male snap 160 into female snap 150 causes the perimeter ridge 162 to enlarge opening 155 followed by the tabs 152 snapping about the narrower exterior diameter of the ring portion of male snap 160 behind wider ridge 162. As a result the arm/flag 70 can articulate and pivot relative to the back panel 80.

Figure 16:
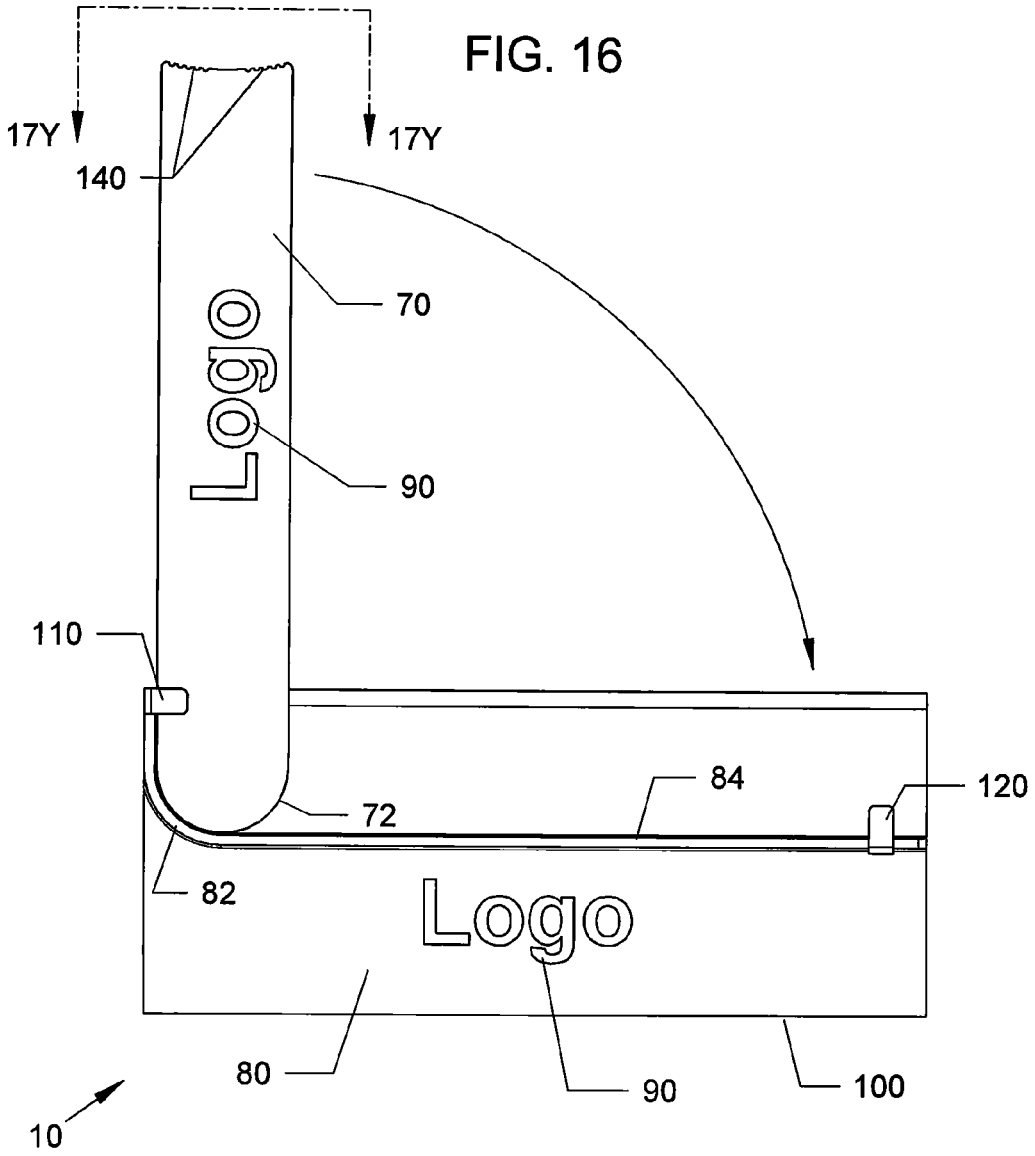
FIG. 16 is a front view of the clamp with pivoting arm/flag assembly of FIG. 4 with the arm/flag in a raised up(open) position.
Figure 17:
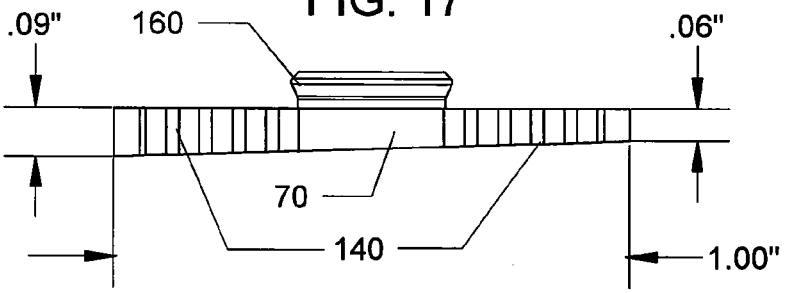
FIG. 17 is a top view of the clamp with pivoting arm/flag of FIG. 16 along arrows 17Y showing male pivot snap (160) and grip knurl (140) detail.

FIG. 16 is a front view of the clamp with pivoting arm/flag assembly 10 of FIG. 4 with the arm/flag 70 in a raised up(open) position. FIG. 17 is a top view of the clamp with pivoting arm/flag 70 of FIG. 16 along arrows 17Y showing male pivot snap 160 and grip knurl 140 detail. The arm/flag 70 can be seen to be tapered along its length so that it is weighted in such a way as to want to stay up when the arm/flag 70 is raised. The base of arm/flag 70 can have a thickness of approximately 0.09" and outer tip end having thickness of approximately 0.06" across a length of approximately 1".

Second Embodiment

FIGS. 18-25 cover the novel clamp with pivoting arm/flag having a clamping thickness of approximately ⅞" to approximately 1½" with a hidden pin connection.

FIG. 18 is a top perspective view of another embodiment of the clamp with pivoting arm/flag assembly 180 clipped to an edge of a smaller thickness tables 200 (approximately ⅞" to 1.5" thick). Similar to FIG. 1, the serving glass 30 is shown full so no service is required so the server flag 70 is down relative to back panel 190.

FIG. 19 is another perspective view of the clamp with pivoting arm/flag assembly 180 clipped to the edge of the table 200 of FIG. 18 with the arm/flag 70 being raised by patron's finger on their hand 130. Here, the serving glass 30 is near empty. The patron can use a finger from their hand 130 placed on the grip knurl 140 of the arm/flag 70 to raise the arm/flag 70 thereby alerting the server that service is desired.

FIG. 20 is a front view of the clamp with pivoting arm/flag assembly 180 of FIG. 19 with arm/flag 70 in lowered closed position. FIG. 21 is a rear view of the clamp with pivoting arm/flag assembly 180 of FIG. 20. FIG. 22 is a top view of the clamp with pivoting arm/flag assembly 180 of FIG. 20. FIG. 23 is a bottom view of the clamp with pivoting arm/flag assembly 180 of FIG. 20. FIG. 24 is a right side view of the clamp with pivoting arm/flag 180 of FIG. 20 clipped to the edge of a table 200 shown in FIG. 18. FIG. 25 is a left side view of the clamp with pivoting arm/flag assembly 180 of FIG. 20.

Referring to FIGS. 18-25, the assembly 180 works and functions similar to the assembly 10 in the previous embodiment. Here, the space between the lower leg tip 52 and the under surface of upper leg 60 can be approximately ⅞", with an overall spacing when opened to approximately 1.50" with the clamp range 210 between these values as shown in FIG. 24.

Third Embodiment

FIGS. 26-37 cover the novel clamp with pivoting arm/flag having a clamping range of approximately ½" to approximately 2" with a more efficient pin connection.

FIG. 26 is a top perspective view of the clamp with pivoting arm/flag assembly 220 similar to the preceding figures clipped to an outer edge of a table 200 with arm/flag 70 in the down position. Here, a sales receipt 240 and/or a credit card 230 are shown inserted between the front of back panel 260 and the lowered arm/flag 70.

FIG. 27 is another view of the clamp with pivoting arm/flag assembly 220 of FIG. 26 with arm/flag 70 raised to an up open position to rest against clip 270 which can function as a stop to limit travel of the arm/flag 70 to a generally upright vertical position.

FIG. 28 is a front view of the clamp with pivoting arm/flag assembly 220 with a pivoting pin locking plug 250 attaching the arm/flag 70 to the back panel 260 of the assembly 220. FIG. 29 is a rear view of the clamp with pivoting arm/flag assembly 220 of FIG. 28. FIG. 30 is a top view of the clamp with pivoting arm/flag assembly 220 of FIG. 28. FIG. 31 is a bottom view of the clamp with pivoting arm/flag assembly 220 of FIG. 28. FIG. 32 is a right side view of the clamp with pivoting arm/flag assembly 220 of FIG. 28 clipped onto an outer edge of a table 300. Here, the table 300 can have a thickness of approximately 0.50" to approximately 2.00". FIG. 33 is a left side view of the clamp with pivoting arm/flag assembly 220 of FIG. 28.

Referring to FIGS. 26-33, the assembly can function similar to the previous embodiments. Here, the space between the lower leg tip 52 and the under surface of upper leg 60 can be approximately ½", with an overall spacing when opened to approximately 2" with the clamp range between these values as shown in FIG. 32.

FIG. 34 is an exploded front perspective view of the clamp with pivoting arm/flag assembly 220 of FIG. 28 with arm/flag 70 separated from the assembly 220. FIG. 35 is an exploded rear perspective view of the clamp with pivoting arm/flag assembly 220 shown in FIG. 34 with arm/flag 70 separated from the assembly 220. FIG. 36 is an enlarged rear perspective view of the pivot pin snap features in the assembly 220 spaced from the arm/flag 70 and pivot pin 250. FIG. 37 is a cross-sectional view of the arm/flag 70 attached to the assembly along arrows 37Y shown in FIG. 36.

Referring to FIGS. 26-37, the assembly 220 can function similar to the previous embodiments. Here, a pivot pin locking plug 250 can have a prong portion with narrow stem and catch edge 252 and tapered tip 258. Rigid back panel 260 can have a raised pivot female snap features 280 that can include a plurality of arc cut-outs 282 with a raised tabs 284 forming a generally cylindrical configuration with inwardly protruding portions 288 forming a narrow opening therebetween, and outwardly protruding portions 286. On the articulating end of the arm/flag 70 can be a pivot female snap feature 290 that can have an outer raised dome portion 292 with a lower circumferential ledge 294 inside the opening of the dome 292 having a narrow opening formed between the inner circumferential ledge 294.

Pushing the pivot female snap feature 290 on the arm/flag 70 against the pivot pin male snap feature 280 on the back panel 260 causes outwardly protruding portions 286 to catch on the inner circumferential ledge 294 in the dome 292 on the arm/flag 70. Next, pushing the tip 258 of prong 250 into the outer opening of the dome 292 allows for the catch edge 252 to snap about the inwardly protruding portions 288 of the pivot pin male snap feature 280.

The term "approximately" can be +/−10% of the amount referenced. Additionally, preferred amounts and ranges can include the amounts and ranges referenced without the prefix of being approximately.

Although some embodiments show male attachment features on the arm/flag and female attachment features on the back panel, the invention can be used with reversing the locations of the male attachment members to be on the back panel and female attachment members to be on the arm/flag. Thus, the location of the female and male attachment members can be reversed on all of the embodiments.

While the embodiments refer to plastic parts, the invention can be formed from other materials, such as but not limited to metal, and the like. Additionally, the clamp portion can be formed from plastic and the arm/flag formed from metal, or vice versa. Still furthermore, the arm/flag or clamp can be formed from cardboard, etc. with the other part formed from another material.

Although the preferred embodiments show the invention being clamped about the edge of a table, the invention can be clamped about edges of countertops, as well as other edges. For example, the invention can be clamped about chair armrests and be modified to clamp on chair backs, and the like.

While the embodiments describe using separate members to form a pivot point, the pivot pins can be substituted by a live hinge at the horizontal or vertical axis, so that the entire assembly (clamp and arm/flag) is one component, and not separate components. For example, a single molded plastic clamp and pivotal arm/flag can come from one mold, and the like. Or the single clamp and pivotal arm/flag can be formed from one cardboard piece.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A signaling device for notifying servers, comprising:

a plastic molded clamp having a front and a rear, the rear of the clamp having a top flat leg and a bottom upwardly angled leg, the front of the clamp having a generally rectangular configuration with top and bottom sides being longer than left and right sides, the top flat leg being perpendicular to the front of the clamp, the rear of the clamp for attaching about a horizontal edge portion of a piece of furniture, so that the rectangular configuration of the front of the clamp with the top and bottom sides being in a horizontal orientation covering the horizontal edge portion of the piece of furniture; and a plastic molded articulating elongated member having a first end pivotally attached to the front of the clamp, and a second end which extends away from the first end, the elongated member having a first lowered horizontal position generally parallel to and overlapping across the front of the clamp, and being pivotal to a second raised position being substantially angled to the front of the clamp with the second end raised upward from the front of the clamp.

2. The signaling device of claim 1, wherein the clamp includes:

a one piece clip.

3. The signaling device of claim 1, wherein the top flat leg includes outer convex curved edges.

4. The signaling device of claim 1, wherein the top flat leg includes outer tapered or beveled edges.

5. The signaling device of claim 1, further comprising:

a hinge along the bottom side of the front of the clamp for allowing the bottom leg to adjust to different clamp ranges about the edge portion on the piece of furniture.

6. The signaling device of claim 1, wherein the piece of furniture includes an outer edge of a table top.

7. The signaling device of claim 1, wherein the piece of furniture includes an outer edge of a counter top.

8. The signaling device of claim 1, further comprising:

a catch for limiting travel of the articulating elongated member in the first lowered position to be substantially horizontal to the clamp.

9. The signaling device of claim 1, further comprising:

a catch for limiting travel of the articulating elongated member in the second raised position to be substantially perpendicular to the clamp.

10. The signaling device of claim 1, further comprising:

a male member mateably attached to a female member to allow for pivotally attaching the first end of the elongate member to the front of the clamp.

11. The signaling device of claim 1, further comprising:

indicia on an outer exposed surface of the elongated member.

12. The signaling device of claim 1, further comprising:

indicia on an outer exposed surface of the front of the clamp.

13. A signaling device for notifying servers, comprising:

a clamp having a front and a rear, the rear for attaching about an edge of a piece of furniture; and an articulating elongated member having a first end pivotally attached to the front of the clamp, and a second end which extends away from the first end, the elongated member having a first lowered position generally adjacent to and substantially covering across the front of the clamp, and a second raised position being substantially angled to the to the front of the clamp with the second end raised from the front of the clamp, wherein the elongated member includes:

an elongated arm with the second end having a knurled surface designed to allow easy traction for a patron's finger.

14. The signaling device of claim 13, wherein the elongated member includes:

the elongated arm with the first end having a convex curved surface.

* * * * *